US006098614A

United States Patent [19]

Fleming

[11] Patent Number: 6,098,614

[45] Date of Patent: Aug. 8, 2000

[54] FLAMMABLE FLUID FUELED HEATER

[75] Inventor: John Stuart Fleming, Onehunga, New Zealand

[73] Assignee: Superior Fireplace Company, Fullerton, Calif.

[21] Appl. No.: 08/926,956

[22] Filed: Sep. 10, 1997

Related U.S. Application Data

[63] Continuation of application No. 08/763,926, Dec. 12, 1996, abandoned, which is a continuation of application No. 08/361,761, Dec. 22, 1994, abandoned.

[30] Foreign Application Priority Data

Dec. 23, 1993 [NZ] New Zealand ..... 250596

[51] Int. Cl.[7] ..... F24C 3/00

[52] U.S. Cl. ..... 126/512

[58] Field of Search ..... 126/512

[56] References Cited

U.S. PATENT DOCUMENTS

| | | | |
|---|---|---|---|
| 1,752,007 | 3/1930 | Kline | 126/202 |
| 1,884,746 | 10/1932 | Kline et al. | 126/92 AC |
| 3,277,882 | 10/1966 | Rose | 126/512 |
| 4,458,662 | 7/1984 | Barnett | 126/77 |
| 4,479,921 | 10/1984 | Allaire et al. | 126/77 |
| 5,320,086 | 6/1994 | Beal et al. | 126/512 |
| 5,816,237 | 10/1998 | Fleming | 126/512 |

*Primary Examiner*—Carroll Dority
*Attorney, Agent, or Firm*—Christie, Parker & Hale, LLP

[57] ABSTRACT

This invention relates to a flammable fluid fuelled heater providing a flueless option with the provision of a catalytic converter in a secondary combustion chamber. Additionally, the heater is provided to give a substantially yellow flame typical of a traditional log fireplace and an open front to the heater. To control emissions, a catalytic converter is provided on the exhaust and the open front is sized to minimise spillage out the open front of the unit.

Additionally, a heater collector is provided over the primary combustion chamber to collect heat and direct this towards the secondary combustion chamber to provide a sufficient environment for operation of the catalytic converter.

5 Claims, 1 Drawing Sheet

FLAMMABLE FLUID FUELED HEATER

CROSS-REFERENCE TO RELATED APPLICATIONS

This is a continuation of application Ser. No. 08/763,926, filed Dec. 12, 1996, now abandoned, which is a continuation of application Ser. No. 08/361,761, filed Dec. 22, 1994 now abandoned.

BACKGROUND i. Field of the Invention

This invention relates to flammable fluid fuelled heaters and, in particular, although not necessarily solely, gas fuelled heaters which at least partially exhaust into a room in which they are housed.

ii. Description of the Prior Art

Traditional flammable fluid fuelled heaters such as a gas fuelled heater comprise a combustion and a flue to exhaust the products of that combustion externally of the room in which the unit is housed. The provision of such flues in a house or similar structure which does not have a provision for such a unit can provide difficulties and extra cost. Also, the flue exhausts heated air into the atmosphere wasting this quantity of heat produced by the heater.

Further, conventional gas fuelled heaters are often provided if the combustion chamber has been substantially enclosed other than air vents at the base of the article to draw air through the unit. Although some units exist having a substantially open front to the gas heater, the emissions from such a heater are in the order of 200 ppm of carbon monoxide into the room in which the unit is housed. This is undesirable from both a health risk in the build up of carbon monoxide and there is also an unpleasant smell from residual unburnt hydrocarbons.

In an attempt to reduce the emissions from such a gas fuelled heater having a substantially open front, the gas and oxygen mixture can be altered such that the combustion provides an invisible or blue flame. Although such a flame is cleaner in the emissions produced, it detracts from the visual aspects of the heater in which there is a desire to see a yellow flame such as would be produced in a typical log fireplace.

Further, some prior art designs for gas heaters are provided such as U.S. Pat. No. 1,884,746. The device described in this patent provides a catalytic converter in a secondary combustion chamber to reduce the quantity of carbon monoxide in the emissions. However, such a device relies on the use of incandescent or radiant tubes above the burner to, in addition to providing radiant heat towards the front of the apparatus, direct the emissions to a point high in the combustion chamber from which they can be directed through the catalytic converter to the outlet. If such an apparatus had the radiant tubes removed so as to provide a flame which is both yellow/orange in colour visible from the front of the unit excessive emissions may spill out the open front of the unit beyond levels desirable or, in some cases, allowable by law.

OBJECT OF THE INVENTION

It is an object of the present invention to provide a flammable fluid fuelled heater which overcomes some of the disadvantages of the prior art or at least provides the public with a useful choice.

SUMMARY OF THE INVENTION

A flammable fluid fuelled heater comprising:

a primary combustion chamber;

a flammable fluid supply to said primary combustion chamber to, upon combustion, provide a substantial portion of yellow flame;

a secondary combustion chamber in communication with said primary combustion chamber to receive and further combust at least a portion of the products of the primary combustion and comprising or including a catalytic converter;

an exhaust port in communication with said secondary combustion chamber to exhaust at least a portion of the products of the secondary combustion into the room in which the heater is house; and an air inlet into said primary combustion chamber covering a substantial portion of a wall of said primary combustion chamber so as to provide a view of a substantial portion of the yellow flame of said primary combustion.

BRIEF DESCRIPTION OF THE DRAWINGS

Other aspects of the invention which should be considered in all its novel aspects will become apparent from the following description now described with reference to the accompanying drawings in which.

DETAILED DESCRIPTION OF PREFERRED EMBODIMENTS

Figure 1:
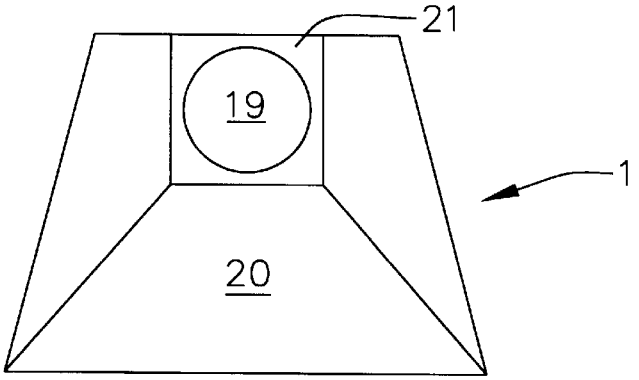
FIG. 1 is a plan view of a heater in accordance with one embodiment of the apparatus.

Referring to the drawings, the invention comprises a flammable fluid fuelled heater. The flammable fluid fuel may comprise any convenient type, however, the invention may be particularly directed to gas heaters for use in conjunction with compressed natural gas or liquified petroleum gas.

The heater 1 has a primary combustion chamber 2 into which the gas or other flammable fluid is supplied and combusted.

Figure 3:
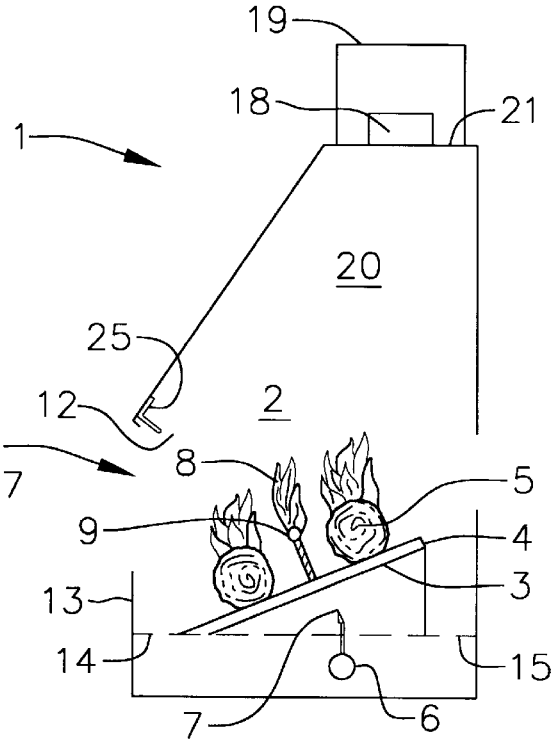
FIG. 3 is a cross-sectional view through the apparatus of FIGS. 1 and 2.

As shown in FIG. 3, the primary combustion chamber 2 may include a rack or similar means 3 covered in perlito or any other suitable substance 4 and also having artificial logs 5 so as to provide the appearance of natural timber fireplace.

The gas itself is supplied through a supply means 6 having a nozzle 7 to direct the gas to the underside of the rack 3 through the perlite bed and to be ignited on the upper side of the bed 4. Although this is the preferred arrangement, any other suitable arrangement for combustion of the gas within the chamber 2 could be used.

Figure 2:
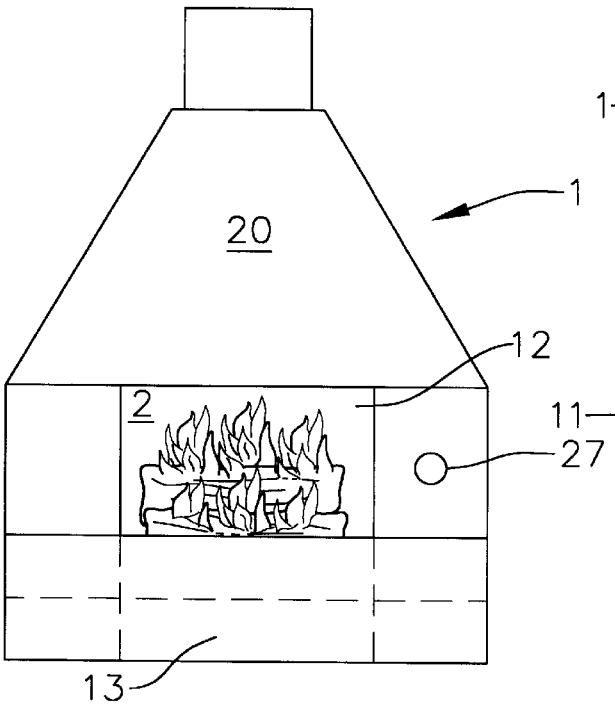
FIG. 2 is a front elevation of the heater of FIG. 1.

This invention provides a somewhat yellow/orange flame represented by flames 8 as shown in FIGS. 2 and 3. The flames 8 of this type may be provided through the mixture of the flammable fluid and oxygen provided through the nozzle 7 to the combustion area and/or may be enhanced or created by a flame enhancer 9 provided within the combustion chamber 2. Again, these features are interchangeable with any other convenient conventional technology and the provision of the yellow flame 8 is for the aesthetic appearance such flames provide to the fire place as a whole.

For combustion to occur in the primary combustion chamber 2, an air inlet must be provided so as to introduce a draft containing oxygen. In this preferred form shown in the Figures, the inlet 11 is provided by an opening 12 covering a substantial portion of a wall of the primary combustion chamber 2.

The air entering the combustion chamber 2 having passed through the region of combustion and lost a quantity of oxygen to the combustion process will now carry the emissions such as carbon monoxide and other pollutants towards a secondary combustion region 18. The secondary combustion region may be a chamber comprising or including a catalytic converter. The secondary combustion chamber 18 is in communication with the primary combustion chamber 2 and provides secondary combustion to the products of the primary combustion to reduce the level of harmful emissions such as carbon monoxide within the outputted air flow.

An exhaust port 19 is provided to exhaust the final products from the region of the secondary combustion 18.

Although the Figures show an alternative in which all the products on the primary combustion are directed through the region of the secondary combustion and exhausted out exhaust port 19, it may be that only a percentage of the output is exhausted through exhaust port 19 and into the room in which it is housed. The remainder may be directed out a flue to the outside and may or may not require the secondary combustion provided by the catalytic converter 18.

Regulations in various countries provided an upper limit on the quantity of heat supplied by a heater. For example, in Australasia, a limit of twenty-six mega joules per hour (26 MJ/hr) has been set. Although this requirement generally relates to the quantity of gas supplied to the heater, this requirement is provided to limit the output from the heater into the room in which it is housed and, should a portion of the exhaust from the heater be directed out a flue directly to the outside, the input quantity of gas into the heater may possibly be raised to provide a better visual flame and the excess heat generated by the greater flame exhausted to the outside atmosphere. Of course, this may be done directly from the primary combustion chamber without diverting through the catalytic converter. However, if emission controls are necessary or desirable for exhaust or external flues, this could be diverted from the exhaust after all the exhaust has passed through the catalytic converter.

The air exhausted out of exhaust port 19 directly into the room in which the heater is housed will provide an air flow from the exhaust port 19 of an increased temperature to improve the efficiency of the heating of the room by the heater 1.

Although a number of different types of catalytic converter could be used in conjunction with this invention, one such suitable catalytic converter that has been found in a CORNING LONG LIFE catalytic converter. Preferably said converter provides 16 cells per inch although 9 or 25 cell per inch standard converters are possible or other alternatives.

The most preferred embodiment of this invention is shown in the Figures and provides the open front 12 as at least a partial inlet for the air flow into the primary combustion chamber 2 and, more importantly, provides an unobstructed view of at least a substantial portion of the fire within the primary combustion chamber 2. This is an important aesthetic consideration.

The catalytic converter 18 requires a minimum temperature of greater than 200 degrees Celsius for efficient operation of the catalytic converter 18. It has been found that a working temperature of 240 degrees Celsius or greater is suitable.

Although this temperature of 240 degrees Celsius or greater may be provided within a heater having a substantially enclosed primary combustion chamber other than vented inlets, it has been found that such a temperature can also be achieved with an apparatus having an opening 12 as demonstrated in the drawings provided a suitable heat collection means 20 is provided to capture heat rising from the primary combustion chamber 2 and carry such heat towards the secondary combustion chamber 18. In this preferred form of the invention, the heat collection means 20 comprises a hood or roof on the primary combustion chamber 2. More preferably, the collection means 20 is tapered from its capture area over the primary combustion chamber 2 towards the uppermost end at or adjacent which the secondary combustion chamber 18 resides. The steep walled hood as shown in the drawings tapers towards and uppermost plate 21 on which the exhaust port 19 is connected and the catalytic converter secondary combustion chamber 18 is provided adjacent this uppermost plate 21 and, as shown in this preferred form, positioned just inside the start of the exhaust port 19.

To provide a flammable fluid fuelled heater having suitable emissions for direction of the emissions directly into the room in which the heater is housed, it is necessary to control the draft through the primary combustion chamber 2 and out the exhaust port 19 so as to limit the cooling effect of the draft on the secondary combustion chamber 18. The catalytic converter 18 may itself be quite restrictive of the air flow through the exhaust port 19 leading to an increase in temperature in that region or, if the catalytic converter 18 does not sufficiently reduce the air flow, a more restrictive cowling placed over the exhaust port 19 may assist in raising the temperature in the region of the catalytic converter 18.

Another factor to be balanced is the requirement to ensure that spillage of combusted gasses from the primary combustion does not occur in the open front door 12 into the room in which the heater is housed. It has been found that the balancing of the size of the opening to ensure this is balanced against the draft travelling out the exhaust port 19 can provide an opening 12 which still provides a view of a substantial portion of the combustion taking place in the primary combustion chamber 2 and yet limits the spillage particularly around the sides of the opening into the room in which it is housed.

Other features to assist in the restriction of spillage may be provided such as the lip 25 running adjacent the top edge of the opening 12 to redirect circulating gasses within the heat collection means 20 back into the primary combustion chamber or heat collection means 20 and away from the opening 12.

It has been found that given a specific exhaust 19 or chimney and a given draft through the unit as well as a given catalytic converter 18, heat collection means such as a hood 20 and quantity of gas going into the primary combustion chamber 2, a maximum size of opening 12 can be determined by experiment to avoid spillage back into the room in which the heater is housed. A simple smoke test with a smoking substance held within the opening 12 and particularly around the edges of the opening 12 while the unit is in operation can provide an indication as to the tendency of the air flow through the opening 12 to travel through or spill out of the opening 12. It will be appreciated by those skilled in the art that such a test can be done on a prototype model to provide the necessary information for production models.

The heating apparatus 1 also contains a control means 27 so that an operator may ignite the gas supplied to the primary combustion chamber 2 regulate the flow the gas to control the quantity of heat supplied, etc.

Although the unit shown in the drawing provides a primary combustion chamber 2 of substantially trapezoidal plan cross-section, any convenient shape of chamber could be used in conjunction with the invention.

Thus it can be seen that a flammable fluid fuelled heater can be provided which allows direction of the products of the combustion into the room in which the heater is housed to reduce heat loss through the direct exhausting of such gasses and yet reduce the emissions into the room as a whole compared with conventional heaters.

Furthermore, the invention may provide a heater 1 having a substantially open face 12 to provide an unobstructed view of the fire and yet still limit the spillage into the room through the open door 12 and, if desired, emit at least a portion of the exhaust gasses from exhaust port 19 into the room in which the heater 1 is housed.

Where in the foregoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope or spirit of the invention.

I claim:

1. A flammable fluid fuelled heater comprising:

a primary combustion chamber;

a flammable fluid supply to said primary combustion chamber to, upon combustion, provide a substantial portion of yellow flame;

a secondary combustion chamber in communication with said primary combustion chamber to receive and further combust at least a portion of the products of the primary combustion and comprising a catalytic converter;

an exhaust port in communication with said secondary combustion chamber to exhaust at least a portion of the products of the second combustion into the room in which the heater is housed;

an air inlet into said primary combustion chamber covering a substantial portion of a wall of said primary combustion chamber so as to provide an unobstructed view of a substantial portion of the yellow flame of said primary combustion; and a sloping roof or hood forming a top portion of the primary combustion chamber, wherein said roof or hood extends from said inlet to or adjacent to said secondary combustion chamber.

2. A flammable fluid fuelled heater as claimed in claim 1 wherein said flammable fluid comprises a flammable gas such as natural gas or liquefied petroleum gas.

3. A flammable fluid fuelled heater as claimed in claim 1 wherein said heater includes control means to ignite and/or regulate and/or control the fuel supply to said primary combustion chamber.

4. A flammable fluid fuelled heater comprising:

a primary combustion chamber;

a flammable fluid supply to said primary combustion chamber to, upon combustion, provide a substantial portion of yellow flame;

a secondary combustion chamber in communication with said primary combustion chamber to receive and further combust at least a portion of the products of the primary combustion and comprising a catalytic converter;

an exhaust port in communication with said secondary combustion chamber to exhaust at least a portion of the products of the secondary combustion into the room in which the heater is housed;

an air inlet into said primary combustion chamber covering a substantial portion of a wall of said primary combustion chamber so as to provide an unobstructed view of a substantial portion of the yellow flame of said primary combustion; and a sloping roof or hood forming a top portion of the primary combustion chamber, wherein said roof or hood extends from said inlet to or adjacent to said secondary combustion chamber, and wherein said air inlet into said wall of said primary combustion chamber is sized in accordance with the draft characteristics of the exhaust port and the inlet to inhibit the spillage of products from said primary combustion out said air inlet.

5. A flammable fluid fuelled heater as claimed in claim 4 wherein said sloping roof or hood comprises an inwardly directed flange proximate said air inlet to redirect circulating gases within said sloping roof or hood away from said air inlet.

* * * * *